US005566864A

United States Patent [19]

Stolz

[11] Patent Number: 5,566,864

[45] Date of Patent: Oct. 22, 1996

[54] CHILDPROOF CLOSURE FOR A CONTAINER COMPRISING A LOWER PORTION WITH EXTENSIBLE SPOUT AND A SCREW CAP

[75] Inventor: Heinrich Stolz, Neunkirchen, Germany

[73] Assignee: Heinrich Stolz GmbH & Co. KG, Germany

[21] Appl. No.: 307,736

[22] PCT Filed: Mar. 25, 1993

[86] PCT No.: PCT/DE93/00279

§ 371 Date: Nov. 28, 1994

§ 102(e) Date: Nov. 28, 1994

[87] PCT Pub. No.: WO93/18983

PCT Pub. Date: Sep. 30, 1993

[30] Foreign Application Priority Data

Mar. 26, 1992 [DE] Germany ..... 42 09 784.3

[51] Int. Cl.[6] ..... B67D 5/33

[52] U.S. Cl. ..... 222/153.14; 222/528; 222/529

[58] Field of Search ..... 222/153.14, 527, 222/528, 529, 537

[56] References Cited

U.S. PATENT DOCUMENTS

| | | | |
|---|---|---|---|
| 3,101,856 | 8/1963 | Whiteman, Jr. | 215/9 |
| 3,613,966 | 10/1971 | Summers | 222/529 |
| 4,422,563 | 12/1983 | Babiol | 222/529 X |
| 4,605,135 | 8/1986 | Ryder | 222/153.14 X |
| 5,078,288 | 1/1992 | Fuchs | 215/209 |
| 5,445,298 | 8/1995 | Strong | 222/153.14 |

FOREIGN PATENT DOCUMENTS

| | | | |
|---|---|---|---|
| 2578819 | 9/1986 | France | 222/529 |
| 1924824 | 11/1970 | Germany | 222/529 |
| 3536514 | 3/1987 | Germany . | |
| 9206318 | 5/1992 | Germany . | |
| 2108095 | 5/1983 | United Kingdom . | |

*Primary Examiner*—Joseph Kaufman
*Attorney, Agent, or Firm*—Speckman, Pauley & Fejer

[57] ABSTRACT

A container having a screw cap and a lower closure member to be connected to the container opening by a base member with a pouring spout connected thereto by an extendible bellows. The screw cap is adapted to be screwed onto and off the pouring spout. In order to render the closure childproof the pouring spout of the lower closure member, beyond its external thread, in a transitional region directed towards the bellows, carries a catch projection, which in the screwing-on direction comprises a gradually rising flank and merges into a steep flank. The cap side wall in the fully screwed-on position is in positive engagement with the catch projection and prevents unscrewing of the screw cap. By pressing inwardly the bellows in the region of the catch projection, the positive engagement between the screw cap and the pouring spout is cancelled and the screw cap is released for being unscrewed.

14 Claims, 1 Drawing Sheet

CHILDPROOF CLOSURE FOR A CONTAINER COMPRISING A LOWER PORTION WITH EXTENSIBLE SPOUT AND A SCREW CAP

BACKGROUND OF THE INVENTION

1. Field of the Invention

This invention relates to a closure for a container, having a lower closure member and a screw cap in which the lower closure member is adapted to be connected to the container opening by a base member. A pouring spout is connected to the base member of the lower closure member with an extendible bellows. The screw cap includes a cap bottom and a cap side wall with an internal thread and is adapted to be screwed onto and off the pouting spout which has an outer thread.

2. Description of Prior Art

In known closures at least the lower closure member is manufactured of resilient material so as to permit, by the bellows moving, the pouring spout to move from the down-pressed starting position into the extended pouring position and back again into the starting position.

In the extended pouting position of known closures the screw cap can be unscrewed from the pouring spout, as shown in German Patent Reference DE 35 36 514 A1. In this context extension ears may be moulded onto the cap bottom, and the pouring spout may be sealed by a sealing disc. Once the sealing disc has been removed even a child may unscrew the screw cap and gain access to the contents.

There exists a need to furnish a closure of the aforesaid type with a child protection feature in a simple manner.

SUMMARY OF THE INVENTION

This invention provides a closure as set forth in the opening paragraph, wherein the pouting spout of the lower closure member beyond the external thread, in that transitional region which is directed towards the bellows, carries at least one catch projection, which in the screwing-on direction comprises a gradually rising flank and merges into a steep catch flank. The cap side wall, in the final screwed-on position is in positive engagement with the catch projection and prevents unscrewing of the screw cap. By pressing inwardly the bellows in the region of the catch projection, the positive engagement between the screw cap and the pouring spout is cancelled and the screw cap can be released for being unscrewed.

With this child protection feature, the resilient deformability of the bellows is optimally utilized. The catch projection which is moulded onto the pouring spout in its transitional region to the bellows is in positive engagement with the cap side wall. By radially pressing the bellows inwardly in the region of the catch projection the positive engagement can be disengaged and the screw cap can be released for being unscrewed. This requires simultaneously two operations, which a child is unable to perform. Accordingly, the closure according to this invention is substantially childproof. Only if simultaneously the bellows are radially deformed and the screw cap is turned in the unscrewing direction, can the screw cap be unscrewed from the pouring spout.

According to an advantageous embodiment of this invention two catch projections are molded in diametrical relationship onto the pouring spout, since the bellows are gripped diametrically when being deformed.

A simple catch engagement in relation to the cap side wall is achieved in accordance with one embodiment of this invention because the cap side wall for each catch projection has at least one catch recess taking the form of an axially directed recess, in the free terminal region of the cap side wall.

If, moreover, the cap side wall has circumferentially uniformly distributed alternating catch recesses and catch tabs, the screw cap can be secured in a plurality of angular positions which is advantageous for the design of the screw cap, in order to accommodate tolerances.

In this context, the catch recesses may have a portal-like cross section and a width which corresponds to the width of the catch tabs, and the walls limiting the catch recesses can be radially directed in the cap side wall. The injection molding tool for manufacturing the screw cap can be designed more simply.

A tolerance compensation in an axial direction will be achieved if in the fully screwed-on position of the screw cap, the catch recesses of the cap side wall extend over at least a part of the axial dimension of the catch projections.

It is possible to achieve an adequate catch engagement of the catch projections in the catch recesses of the cap side wall if the the width of the catch recesses corresponds approximately to the mean circumferential dimension of the catch projections.

It is advantageous for handling the closure of this invention if the regions of the bellows which are to be deformed have an additional marking.

BRIEF DESCRIPTION OF THE DRAWINGS

This invention will be further explained by way of a working example illustrated in the drawing wherein.

DESCRIPTION OF PREFERRED EMBODIMENTS

Figure 1:
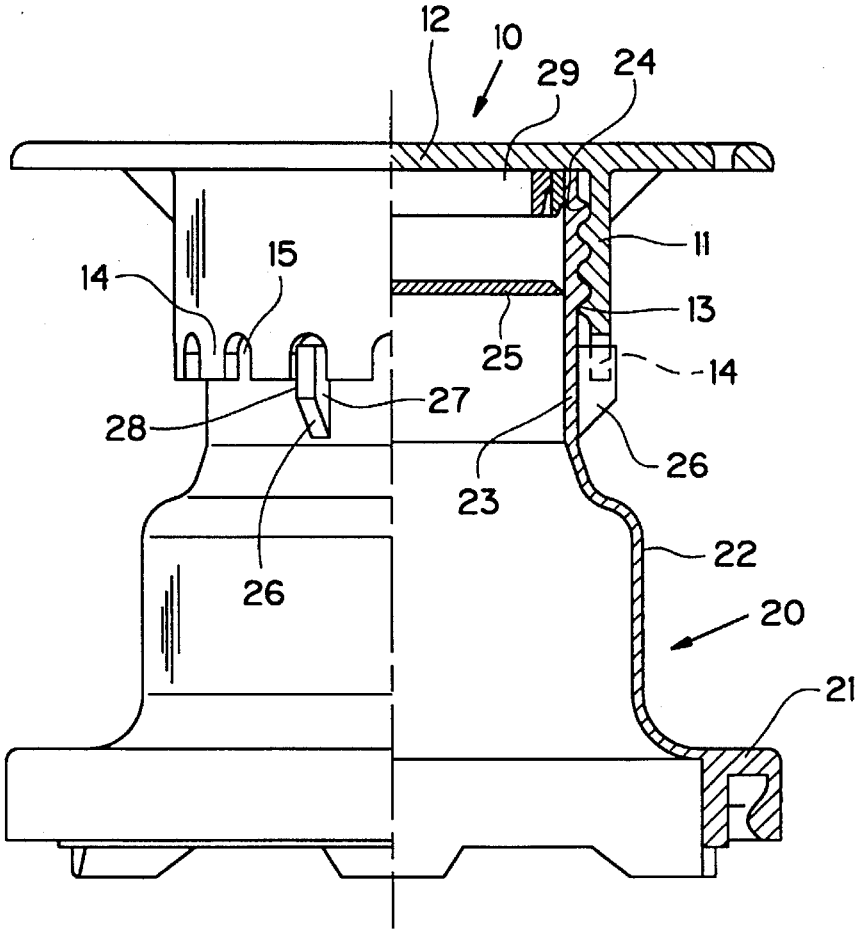
FIG. 1 is a partial cross-sectional view of a closure according to one preferred embodiment of this invention in the extended pouring position of the screwed-on and secured screw cap.
Figure 2:
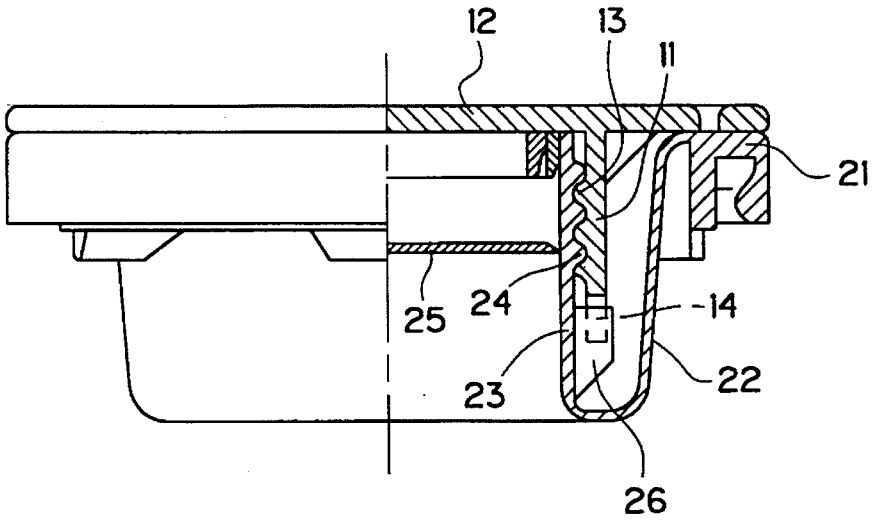
FIG. 2 is a partial cross-sectional view of the closure according to FIG. 1, but only in the pressed down starting position.

The closure means according to this invention comprises a screw cap 10 and a lower closure member 20. The lower closure member 20 includes a U-shaped base member 21 adapted to be applied with a snap action onto a container nipple of the container, which has a catch bead. The base member 21 merges into a resilient bellows 22 which can be brought into an extended position, as shown in FIG. 1. If the bellows 22 are pressed down in the direction of the container nipple, the bellows 22 occupies the starting position illustrated in FIG. 2. The bellows 22 merge into a pouring spout 23 having an external thread 24. The pouring spout 23 is closed by a sealing disc 25 molded on by way of predesigned fracturing points. The sealing disc 25, provided with a handle member 29, can be pulled off the pouring spout 23 if the closure means is brought into the pouring position and the screw cap 10 is unscrewed, in order to open the closure.

The screw cap 10 comprises a cap bottom 12 and a cap side wall 11, having an internal thread 13, whereby the internal thread 13 can be screwed onto or off the external thread 24 of the pouring spout 23. On the transitional region directed towards the bellows 22 of the pouring spout 23 two diametrically opposed catch projections 26 are preferably molded on and comprise a gradually rising flank 27, rising radially outward and merging into a steeply dropping catch flank 28. The catch projections 26 coact with the free end face of the cap side wall 11. The end face of the cap side wall 11 bears alternatingly catch tabs 14 and catch recesses 15 into which the catch projections 26 can engage positively. When screwing on the screw cap 10, the catch tabs 14 are deflected outwardly by the rising flanks 27 of the catch projections 26 so that they can pass the catch projections 26. In the unscrewing position the catch tabs 14 abut against the steep catch flanks 28 of the catch projections 26 and thereby prevent unscrewing of the screw cap 10. The catch recesses 15 and the catch tabs 14 have approximately equal widths and are uniformly distributed over the end face of the cap side wall 11, the catch recesses 15 having portal like cross sections and being open towards the end of the cap side wall 11. The walls, which limit the catch recesses 15, are radially directed. The width of the catch recesses 15 corresponds approximately to the mean circumferential dimension of the catch projects 26 in order to attain a definite catch engagement. The catch engagement between the catch projections 26 of the pouring spout 23 and the cap side wall 11 may also be accomplished by counteracting catch projections on the inside of the cap side wall 11. In any event, the catch connections can be undone by radial inwardly pressing the bellows 22 underneath the catch projections 26 in order to release the screw cap 10 for unscrewing. In doing so, the pouting spout 23 is so far drawn inwardly that the catch projections 26 are withdrawn from the catch recesses 15 in the cap side wall 11.

The claims which follow are to be considered an integral part of the present disclosure. Reference numbers (directed to the drawings) shown in the claims serve to facilitate the correlation of integers of the claims with illustrated features of the preferred embodiments, but are not intended to restrict in any way the language of the claims to what is shown in the drawings, unless the contrary is clearly apparent from the context.

I claim:

1. A closure for a container, comprising: a lower closure member (20), a screw cap (10), and a base member (21), the lower closure member (20) comprising a pouring spout (23) connected to the base member (21) with an extendible bellows (22), the screw cap (10) having a cap bottom (12) and a cap side wall (11) including an internal thread (13), which is engageable with an external thread (24) of the pouring spout (23), the pouring spout (23) of the lower closure member (20), beyond the external thread (24) in a transitional region directed towards the bellows (22), carries at least one catch projection (26), the at least one catch projection (26) comprising a gradually rising flank (27) merging into a steep catch flank (28), the cap side wall (11) in a screwed-on position in positive engagement with the at least one catch projection (26), and by inwardly pressing the bellows (22) near the at least one catch projection (26), positive engagement between the screw cap (10) and the pouring spout (23) is cancelled and the screw cap (10) is released from positive engagement.

2. A closure according to claim 1, wherein two diametrically opposing catch projections (26) are molded on the pouring spout (23).

3. A closure according to claim 2, wherein the cap side wall (11) has for each catch projection (26) at least one catch recess (15) in the cap side wall (11).

4. A closure according to claim 3, wherein the cap side wall (11) has peripherally uniformly distributed alternating said catch recesses (15) and catch tabs (14).

5. A closure according to claim 4, wherein the at least one catch recess (15) has a portal-shaped cross-section and occupies a recess width corresponding to a tab width of the catch tabs (14).

6. A closure according to claim 5, wherein the catch recesses (15) are radially directed in the cap side wall (11).

7. A closure according to claim 6, wherein in the fully screwed-on position of the screw cap (10) the catch recesses (15) of the cap side wall (11) extend over at least a part of an axial dimension of the at least one catch projection (26).

8. A closure according to claim 7, wherein the recess width corresponds to approximately a mean circumferential dimension of the at least one catch projection (26).

9. A closure according to claim 8, wherein a region of the bellows (22) which is to be deformed is marked.

10. A closure according to claim 3, wherein the at least one catch recess (15) is radially directed in the cap side wall (11).

11. A closure according to claim 1, wherein the cap side wall (11) has for each catch projection (26) at least one catch recess (15) axially directed in a free terminal region of the cap side wall (11).

12. A closure according to claim 1, wherein in the fully screwed-on position of the screw cap (10) at least one catch recess (15) of the cap side wall (11) extends over at least a part of an axial dimension of the at least one catch projection (26).

13. A closure according to claim 1, wherein a recess width of at least one recess (15) of the cap side wall (11) corresponds to approximately a mean circumferential dimension of the at least one catch projection (26).

14. A closure according to claim 1, wherein a region of the bellows (22) which is to be deformed is marked.

* * * * *